US005964435A

United States Patent [19]

Peltier

[11] Patent Number: 5,964,435

[45] Date of Patent: Oct. 12, 1999

[54] WALL OR WINDOW MOUNTED GUN SUPPORT

[75] Inventor: Harold R. Peltier, 2711 County Rd., No. 208, Danbury, Tex. 77534

[73] Assignees: Harold R. Peltier, Danbury; Chad Peltier; Joyce A. Peltier, both of Angleton, all of Tex.

[21] Appl. No.: 08/862,475

[22] Filed: May 23, 1997

[51] Int. Cl.[6] ..... F41A 9/62; F16M 11/38; F16M 11/32

[52] U.S. Cl. ..... 248/166; 248/439; 248/440.1; 42/94

[58] Field of Search ..... 248/166, 439, 248/126, 440.1, 188.91, 207, 239; 42/94

[56] References Cited

U.S. PATENT DOCUMENTS

| | | | |
|---|---|---|---|
| 1,367,353 | 2/1921 | Craig | 42/94 |
| 3,935,657 | 2/1976 | Wade . | |
| 4,017,997 | 4/1977 | Peterson et al. . | |
| 5,050,330 | 9/1991 | Pilgrim et al. . | |
| 5,419,233 | 5/1995 | Mulvaney | 42/94 |
| 5,697,180 | 12/1997 | Morizio | 42/94 |
| 5,755,411 | 5/1998 | Strong, III et al. | 248/236 |

*Primary Examiner*—Derek J. Berger
*Assistant Examiner*—Michael Nornberg
*Attorney, Agent, or Firm*—Felsman, Bradley,Vaden, Gunter & Dillon,LLP

[57] ABSTRACT

A durable and portable gun support that is particularly well adapted for use in a hunting blind or stand. The gun support provides a gun rest and support brace that may be hooked over a wall or the bottom of a window opening to give the operator a flat top surface on which to rest a gun. The flat top surface may be adjusted to orient the gun laying on the gun rest toward the expected field of view for firing. This generally correct orientation allows the operator to more quietly, quickly, and accurately aim and fire the gun. The gun support also provides a camera mount that allows the operator to conveniently secure a camera to record activities occurring within the field of view. The gun support may also be employed in two alternate positions to provide convenience of operation and stability during firing for the operator of a two-handed gun. In a first alternate position, the gun support can be oriented with its flat surface generally vertical to support a gun being held in a kneeling position. In another alternate position, the brace can be collapsed and the gun support can be placed on a large flat surface and used as a rest to sight or adjust a gun. The vertical tilt of the gun rest is adjustable by use of an adjusting leg attached at the rear end of the gun rest.

10 Claims, 2 Drawing Sheets

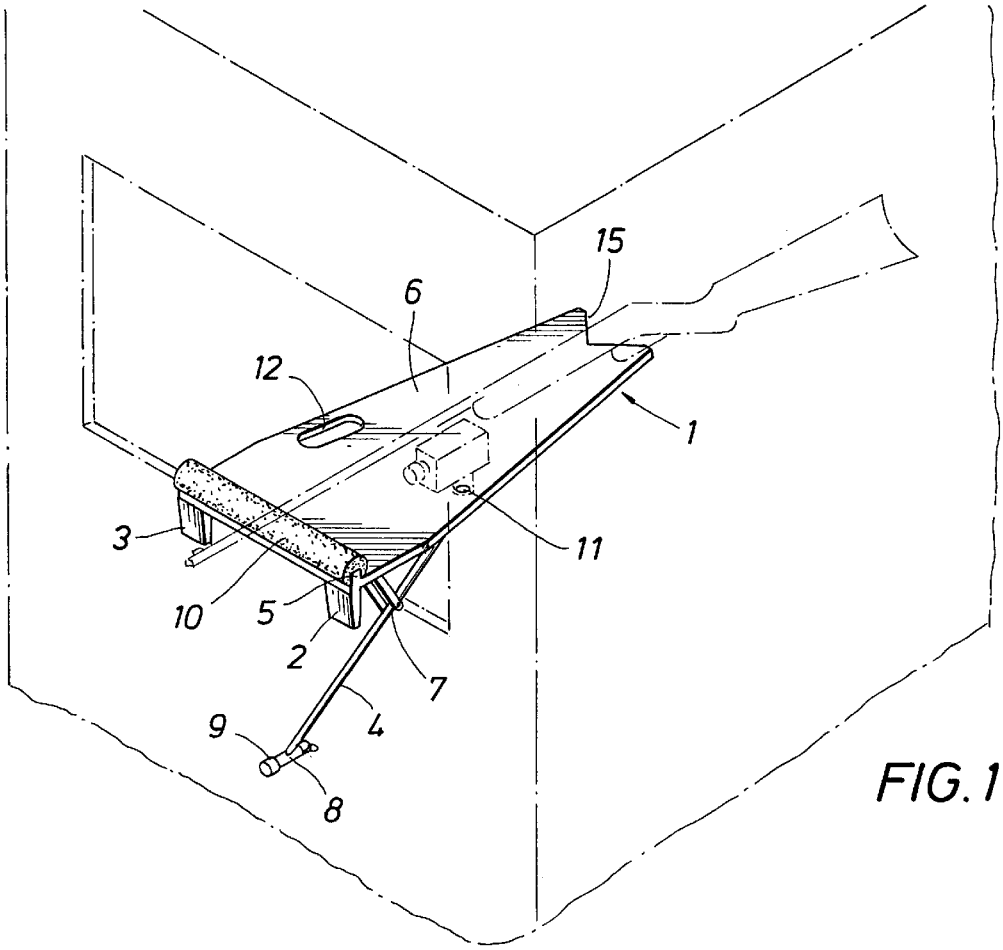
FIG. 1
FIG. 2
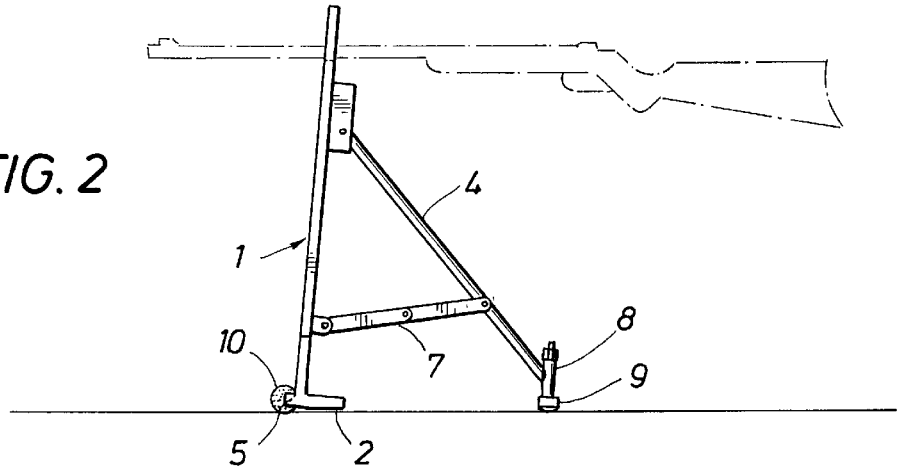
FIG. 3
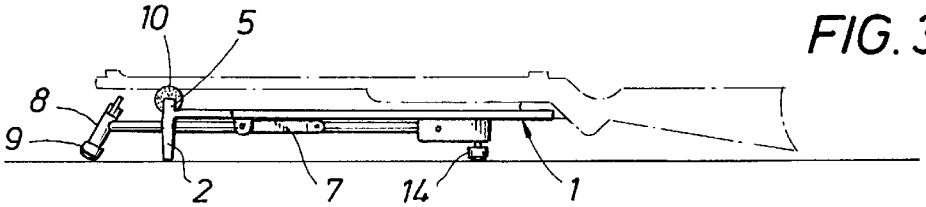

WALL OR WINDOW MOUNTED GUN SUPPORT

BACKGROUND OF THE INVENTION

1. Field of the Invention

The present invention relates to firearm accessories, and more particularly to a two-handed gun support that is useful in supporting a gun on a wall or in the window of a hunting blind or stand. Additionally, the gun support may be useful for supporting a gun from a kneeling position, or for supporting a gun on a large flat surface when adjusting or sighting the gun.

2. Description of the Prior Art

Various devices have been constructed to aid shooters in steadily aiming and firing guns. A number of these devices have been specifically designed to assist with firing guns that required two hands to hold and fire (two-handed guns) such as rifles or shotguns.

In the art of hunting, short reaction time, stealth, and accuracy are favorable attributes for the hunter. Because of the typically long periods that a hunter must wait for prey to enter his field of view, it is fatiguing and thus impractical to hold a gun at a ready position for the entire time. Consequently, a hunter places his gun in some more comfortable position while waiting. When the prey enters the field of view, the hunter repositions the gun. The repositioning of a gun takes time, creates noise, and makes accurate shooting less likely. Therefore, it is advantageous for the hunter to have his gun generally resting to overlook the field of view into which the weapon will be fired.

A common way for hunters to conceal their presence and provide a favorable vantage from which to fire a weapon is to build a wall or a blind with a window through which a gun may be fired. Additionally, the wall or blind may be placed on an elevated stand or in a tree. For a gun support to be useful to a hunter utilizing a wall or blind, the gun support must be adapted for use with the wall or blind.

Three patents describing structures which aid shooters in aiming two-handed guns are U.S. Pat. Nos. 3,935,657, 4,017,997, and 5,050,330. The '657 patent describes a very stable rest for securely holding and firing a rifle. It provides the shooter with a very steady guide, and would be adaptable to hold a gun in a position overlooking a particular field of view for a long period of waiting. However, the rest is not adaptable for use on a wall or through a window. The rest in the '657 patent must be place on a relatively large flat surface. Such a flat surface is typically not available in a hunting stand.

The '997 patent describes a support of a gun barrel by means of a compact pair of adjustable legs that attach to the barrel of the gun. This invention is adequately portable to be usable in a blind or stand. However, since the legs would have to be rested on the edge of a wall or window, arguably it would be no more useful to the hunter than resting the barrel of the gun itself on the edge of the wall or window. Also, the invention would not aid in holding the gun in a position overlooking a particular field of view for a long period. The invention provides no means for pointing the gun in a particular direction by attaching to a wall or window.

The '330 patent pertains to a foam block with U-shaped grooves in which to rest and steady a gun. The '330 structure provides a way to rest a gun over the edge of a window. However, the window envisioned for use with the '330 structure is a vehicle window. The vehicle window pane is partially rolled up to fit into a groove of the rest to keep the rest from moving horizontally. It is doubtful that the invention would be adaptable to a window opening without a partially rolled up window pane. Even if the rest would remain in place without the window pane, the invention is not deep enough to independently hold the gun. Therefore, the invention alone would not hold the gun in a position overlooking a particular field of view for a long period.

Therefore, it is evident that none of these prior patents provides a means for resting a gun in a substantially ready position, steadying a gun while firing, and connecting the structure to a wall or a window opening.

OBJECTS AND ADVANTAGES

In response to these deficiencies in the art, it is an object of the present invention to provide an improved gun support, that in a single structure, will hold a gun on a wall or window opening in a ready position overlooking a particular field of view and will serving as a rest for the gun to steady the gun while aiming and firing.

It is a further object to provide an improved gun support with cushioned surfaces that will minimize wear on the gun and will minimize noise created by placing the gun on and removing the gun from the gun support.

It is a further object to provide an improved gun support that may be collapsed to facilitate storage or transportation of the gun support, or to be used on a large flat surface in sighting or adjusting a gun.

It is a further object to provide an improved gun support that may be placed substantially vertically and upon which a gun may be supported.

Further objects and advantages of the present invention will become apparent from a consideration of the drawings and ensuing description.

SUMMARY OF THE INVENTION

The objects described above, as well as other objects and advantages are achieved by an improved wall- or window-mounted gun support for use with a gun that is typically held and fired with two hands. A generally horizontal gun rest with a generally flat top provides the primary surface on which the gun is rested. The gun rest has a least one depending leg attach to its front end. In a preferred embodiment, the leg or legs overlap the top of a wall or the bottom of a window opening in a wall. The rear end of the gun rest is supported by a brace that is slantedly positionable and adjustably supported against the wall below the gun rest. The brace holds the gun support so that the gun rest and gun may be oriented to align with a predetermined field of view. An elevated surface is attached to the front end of the gun rest for supporting the barrel of the gun. The elevated surface also provides a space between the gun rest and the gun for the forward hand of the operator to more easily lift the gun from its resting position on the gun rest.

In a preferred embodiment, a cushioning layer may be attached to the surface of the gun rest and the elevated surface to minimize wear on the gun and to minimize noise created by placing the gun on and removing the gun from the gun support.

In a preferred embodiment, two legs are attached to the front end of the gun rest so that the gun rest is centered on the two legs. The brace, which may be substantially tubular, can be rotatably collapsed to a storage position with its free end extending between the two legs. With the brace in the storage position, the gun support may be more easily transported or stored. Additionally, the gun support may be employed in an alternate horizontal position. The gun support may be placed horizontally on a large flat surface and used to sight or adjust a gun. The gun rest is equipped with an adjusting leg attached at the rear end of the gun rest for vertically tilting said gun rest from the horizontal while in this alternate position. In a preferred embodiment, the rear end of the gun rest includes a threaded hole and the adjusting leg is matingly externally threaded into the hole to allow for vertical adjustment.

In a second alternate position, the gun support is positioned with its flat surface substantially vertical and the gun is supported in a notch in the rear end of the gun rest, if desired. The brace may either be extended or collapsed while the gun support is in this alternate position.

In a preferred embodiment, the brace is locked by a means to hold the brace in a supportive position. The brace can be held in an extended position that is supportive of the gun rest by any means that connects the brace to the gun rest. A chain, cable, or other tensionable member could be used to connect the brace to the gun rest, if desired. The length of the connection between the brace and the gun rest can be adjusted to change the relative angle of the gun rest with horizontal. The adjustment may be accomplished by using a turnbuckle or other similar adjustment mechanism. In the case of a chain, the length could be adjusted by adding, removing, or binding lengths of the chain. The brace can also be locked by adding an obstruction to the rotation of the brace near the hinged end of the brace. Such a member would effectively connect the brace to the gun rest and inhibit the movement of the brace beyond a certain extension, thereby determining the angle of inclination of the brace when it is in its lowered position.

In a preferred embodiment, the locking means of the brace is a hinge connected at a center position to the underneath side of the rear end of the gun rest to allow the brace to rotatably descend so that the free end of the brace is centered underneath the first end of said gun rest.

In a preferred embodiment, the free end of the brace is fitted with a threaded connector. The threaded connector is mated with a threaded post that rests against the wall and adjustably telescopes with said brace to adjust the tilt angle of the gun rest.

In a preferred embodiment, the gun rest is dimensioned to provide support for the forward arm of the operator during aiming and firing of the gun.

In a preferred embodiment, the gun support may have either or both a camera mount on the gun rest or a handle opening in the gun rest for carrying the gun support.

In a preferred embodiment, the gun rest, the depending leg or legs, and the elevated surface are molded together in one piece.

BRIEF DESCRIPTION OF THE DRAWINGS

In the drawings, wherein like reference characters are used throughout to describe like parts:

FIG. 1 is an isometric view of the gun support embodying the present invention.

FIG. 2 is a side elevation view of the gun support employed in an alternate position with the gun rest's flat surface generally vertical.

FIG. 3 is a side elevation view of the gun support employed in an alternate position on a large flat surface.

DETAILED DESCRIPTION OF THE INVENTION

Figure 5:
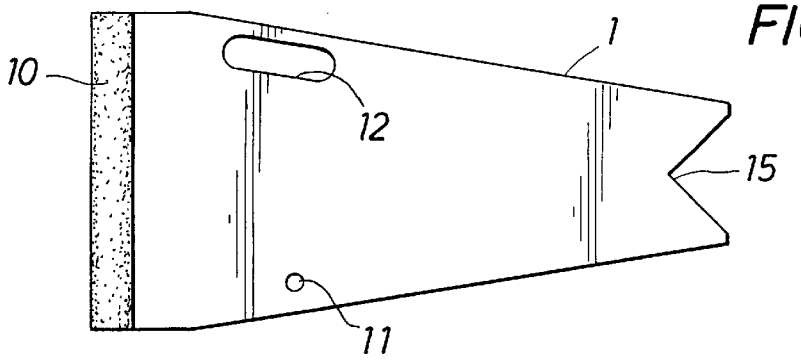
FIG. 5 is a top plan view of the gun support.
Figure 6:
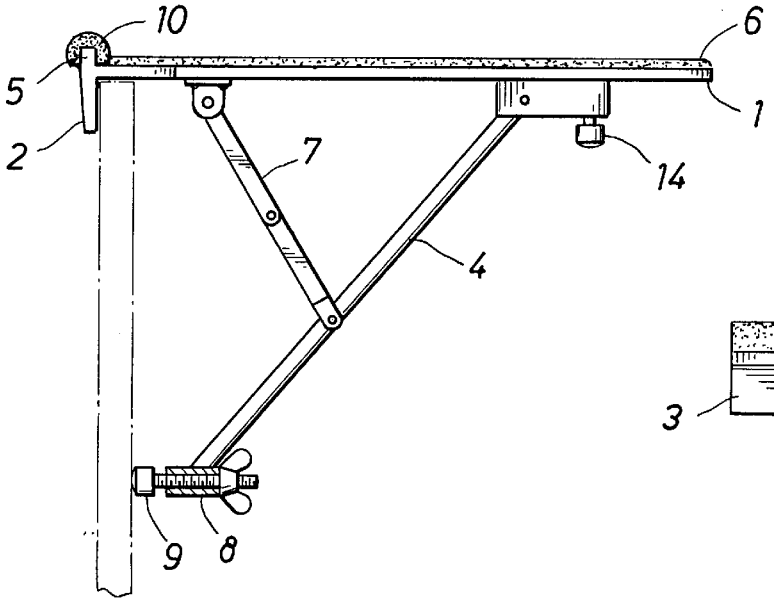
FIG. 6 is a side elevation view of the gun support with the brace in an extended position.
Figure 4:
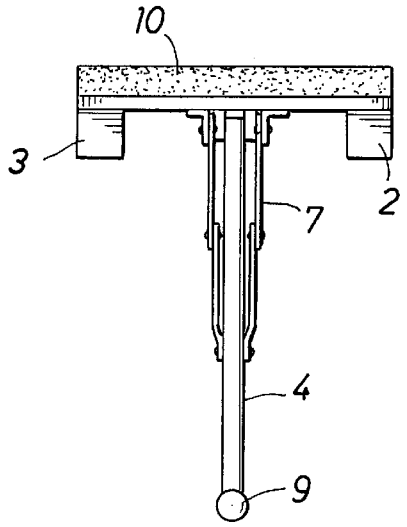
FIG. 4 is a front elevation view of the gun support with the brace in an extended position.

A preferred embodiment of the wall- or window-mounted gun support is shown in FIGS. 1, 4, 5, and 6. A gun rest 1 is shown with its flat surface in near horizontal orientation and with a brace 4 extended. Brace 4 is hingedly connected to the underneath side of the rear end of gun rest 1 and is slantedly positionable to adjust the orientation of the gun rest to overlook a predetermined field of view. Depending legs 2 and 3 are attached to the front of gun rest 1. In this configuration, legs 2 and 3 are hooked over the edge of a wall or a window opening. In the illustrated preferred embodiment of the gun support, the top surface of gun rest 1 is covered by a cushioning layer 6.

An elevated surface 5 is attached to the front end of gun rest 1. Elevated surface 5 provides space between the flat surface of gun rest 1 and a gun resting on the surface. Additionally, elevated surface 5 provides a ledge on which to support the barrel of a gun while firing the gun. In the illustrated preferred embodiment of the gun support, elevated surface 5 is covered by a cushioning material 10.

In the illustrated preferred embodiment of the gun support, a free end 8 of brace 4 is internally threaded to accept a threaded post 9. Threaded post 9 contacts the wall below the front end of the gun rest. Threaded post 9 adjustably telescopes when turned to alter the angle of gun rest 1 by moving brace 4 relative to the wall.

Figure 7:
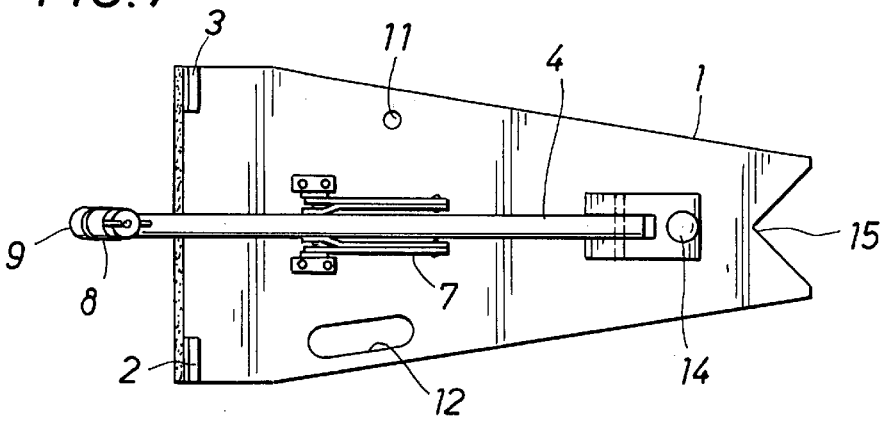
FIG. 7 is a bottom plan view of the gun support with the brace in the folded position for storage.

Brace 4 is locked in an extended position by means of a hinge 7. Hinge 7 connects to a mid position of brace 4 at one end and to the underneath side of gun rest 1 at the other end. Hinge 7 rotates about its mid position to allow brace 4 to rotatably move between an extended position as shown in FIGS. 1, 2, 4, and 6, and a storage position as shown in FIGS. 3 and 7.

In the illustrated preferred embodiment, a camera mount is provided by means of a hole 11 in gun rest 1 through which a bolt of the proper dimension to matingly attach to a camera may be passed. Alternate camera mounts can be provided, if desired. A handle opening 12 is provided in gun rest 1 for carrying the gun support.

In FIG. 2, the gun support is shown in an alternate position with the flat surface of gun rest 1 substantially vertical. In this position, the gun support may be used to steady a gun while firing. Brace 4 may either be extended as shown, or it may be collapsed. A notch 15 is provided in the rear end of gun rest 1 to accept and support the gun. Notch 15 is shown in FIGS. 1 and 5. The notch is shown to be generally V-shaped. Rounded or other shaped notches can also be provided, if desired.

In FIG. 3, the gun support is shown in an alternate position on a large flat surface as would be useful in sighting or adjusting a gun. FIG. 3 shows a threaded adjusting leg 14 matingly attached to the rear end of gun rest 1 through a threaded hole for vertically tilting gun rest 1 from the horizontal.

The alternate positions illustrated in FIGS. 2 and 3 are useful supplemental uses of the gun support. However, in a preferred embodiment of the gun support as used in its primary function as a support attached to a wall or window opening, the gun support may or may not have all of the details necessary to operate as illustrated in FIGS. 2 and 3.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A wall- or window mounted two-handed gun support, comprising:

a gun rest having a generally flat top surface for generally horizontally supporting a gun;

first and second depending legs attached to the front end of said gun rest so that said gun rest is concentrically centered on said first and second legs, the legs further being attached for overlapping the top of a wall or the bottom of a window opening in a wall so that the top of the wall or the bottom of the window opening contacts the bottom surface of said gun rest;

a brace hingedly connected to the underneath side of the rear end of said gun rest slantedly positionable and adjustable for orienting said gun rest to support the gun at rest in approximate alignment to a predetermined field of view;

said brace further being rotatably collapsible to a storage position with a free end of said brace extending between said first and second legs; and an elevated surface attached to the front end of said gun rest for supporting the barrel of the gun and allowing space between said gun rest and the gun for the forward hand of the operator to readily grasp the gun prior to aiming and firing the gun.

2. A wall- or window mounted two-handed gun support, comprising:

a gun rest having a generally flat top surface for generally horizontally supporting a gun;

at least one depending leg attached to the front end of said gun rest for overlapping the top of a wall or the bottom of a window opening in a wall so that the top of the wall or the bottom of the window opening contacts the bottom surface of said gun rest;

a brace hingedly connected to the underneath side of the rear end of said gun rest slantedly positionable and adjustable for orienting said gun rest to support the gun at rest in approximate alignment to a predetermined field of view;

a locking means to hold said brace in a supportive position;

an adjustment means to vary the support of the brace and cause change to the relative angle of the gun rest with the horizontal; and an elevated surface attached to the front end of said gun rest for supporting the barrel of the gun and allowing space between said gun rest and the gun for the forward hand of the operator to readily grasp the gun prior to aiming and firing the gun.

3. A wall- or window mounted two-handed gun support, comprising:

a gun rest having a generally flat top surface for generally horizontally supporting a gun;

at least one depending leg attached to the front end of said gun rest for overlapping the top of a wall or the bottom of a window opening in a wall;

a brace hingedly connected to the underneath side of the rear end of said gun rest slantedly positionable and adjustable for orienting said gun rest to support the gun at rest in approximate alignment to a predetermined field of view;

a hinge connected at a center position to the underneath side of the rear end of said gun rest to allow said brace to rotatably descend therefrom so that the free end of said brace is centered underneath the first end of said gun rest; and an elevated surface attached to the front end of said gun rest for supporting the barrel of the gun and allowing space between said gun rest and the gun for the forward hand of the operator to readily grasp the gun prior to aiming and firing the gun.

4. The gun support of claim 3 further comprising a locking means to hold said brace in a supportive position.

5. A wall- or window mounted two-handed gun support, comprising:

a gun rest having a generally flat top surface for generally horizontally supporting a gun;

at least one depending leg attached to the front end of said gun rest for overlapping the top of a wall or the bottom of a window opening in a wall;

a brace hingedly connected to the underneath side of the rear end of said gun rest slantedly positionable and adjustable for orienting said gun rest to support the gun at rest in approximate alignment to a predetermined field of view;

the brace having a free end that is internally threaded and includes a threaded post mating therewith that rests against a wall and that adjustably telescopes with said brace to thereby adjust the tilt angle of said gun rest; and an elevated surface attached to the front end of said gun rest for supporting the barrel of the gun and allowing space between said gun rest and the gun for the forward hand of the operator to readily grasp the gun prior to aiming and firing the gun.

6. The gun support of claim 5 further comprising:

first and second depending legs attached to the front end of said gun rest so that said gun rest is concentrically centered on said first and second legs; and said brace is further rotatably collapsible to a storage position with a free end of said brace extending between said first and second legs.

7. The gun support of claim 5 further comprising:

a locking means to hold said brace in a supportive position; and an adjustment means to vary the support of the brace and cause change to the relative angle of the gun rest with the horizontal.

8. The gun support of claim 5 further comprising a hinge connected at a center position to the underneath side of the rear end of said gun rest to allow said brace to rotatably descend therefrom so that the free end of said brace is centered underneath the first end of said gun rest.

9. A wall- or window-mounted two-handed gun support, comprising:

a gun rest having a generally flat top surface for generally horizontally supporting a gun, the gun rest having a notch in its rear end for supporting a gun therein when said gun rest is aligned in an alternate position with its flat surface generally vertical;

at least one depending leg attached to the front end of said gun rest for overlapping the top of a wall or the bottom of a window opening in a wall;

a brace hingedly connected to the underside of the rear end of said gun rest slantedly positionable and adjustable for orienting said gun rest to support the gun at rest in approximate alignment to a predetermined field of view; and an elevated surface attached to the front end of said gun rest for supporting the barrel of the gun and allowing space between said gun rest and the gun for the forward hand of the operator to readily grasp the gun prior to aiming and firing the gun.

10. A wall- or window-mounted two-handed gun support, comprising:

a gun rest having a generally flat top surface for generally horizontally supporting a gun;

at least one depending leg attached to the front end of said gun rest for overlapping the top of a wall or the bottom of a window opening in a wall;

a brace hingedly connected to the underside of the rear end of said gun rest slantedly positionable and adjustable for orienting said gun rest to support the gun at rest in approximate alignment to a predetermined field of view;

an elevated surface attached to the front end of said gun rest for supporting the barrel of the gun and allowing space between said gun rest and the gun for the forward hand of the operator to readily grasp the gun prior to aiming and firing the gun; and said at least one leg and said elevated surface being molded together in one piece.

* * * * *